US006638418B1

(12) United States Patent
Kalnes et al.

(10) Patent No.: US 6,638,418 B1
(45) Date of Patent: Oct. 28, 2003

(54) DUAL RECYCLE HYDROCRACKING PROCESS

(75) Inventors: Tom N. Kalnes, LaGrange, IL (US); Vasant P. Thakkar, Elk Grove Village, IL (US); Richard K. Hoehn, Mount Prospect, IL (US)

(73) Assignee: UOP LLC, Des Plaines, IL (US)

( * ) Notice: Subject to any disclaimer, the term of this patent is extended or adjusted under 35 U.S.C. 154(b) by 147 days.

(21) Appl. No.: 10/045,285

(22) Filed: Nov. 7, 2001

(51) Int. Cl.[7] ..... C10G 45/00

(52) U.S. Cl. ..... 208/89; 208/88; 208/59; 208/143; 208/229; 208/57; 208/58; 208/210; 208/254 H

(58) Field of Search ..... 208/89, 88, 59, 208/143, 229, 57, 58, 210, 254 H

(56) References Cited

U.S. PATENT DOCUMENTS

| | | | | |
|---|---|---|---|---|
| 3,540,999 A | 11/1970 | Jacobs | ..... | 208/59 |
| 5,114,562 A | 5/1992 | Haun et al. | ..... | 208/89 |
| 5,720,872 A | 2/1998 | Gupta | ..... | 208/57 |

*Primary Examiner*—Walter D. Griffin
*Assistant Examiner*—James Arnold, Jr.
(74) *Attorney, Agent, or Firm*—John G. Tolcmei; John G. Cutts, Jr.

(57) ABSTRACT

A dual recycle catalytic hydrocracking process for the production of ultra low sulfur diesel while simultaneously processing two feedstocks. One preferred feedstock boils in the temperature range of diesel and the second preferred feedstock boils in the temperature range above that of diesel.

10 Claims, 1 Drawing Sheet

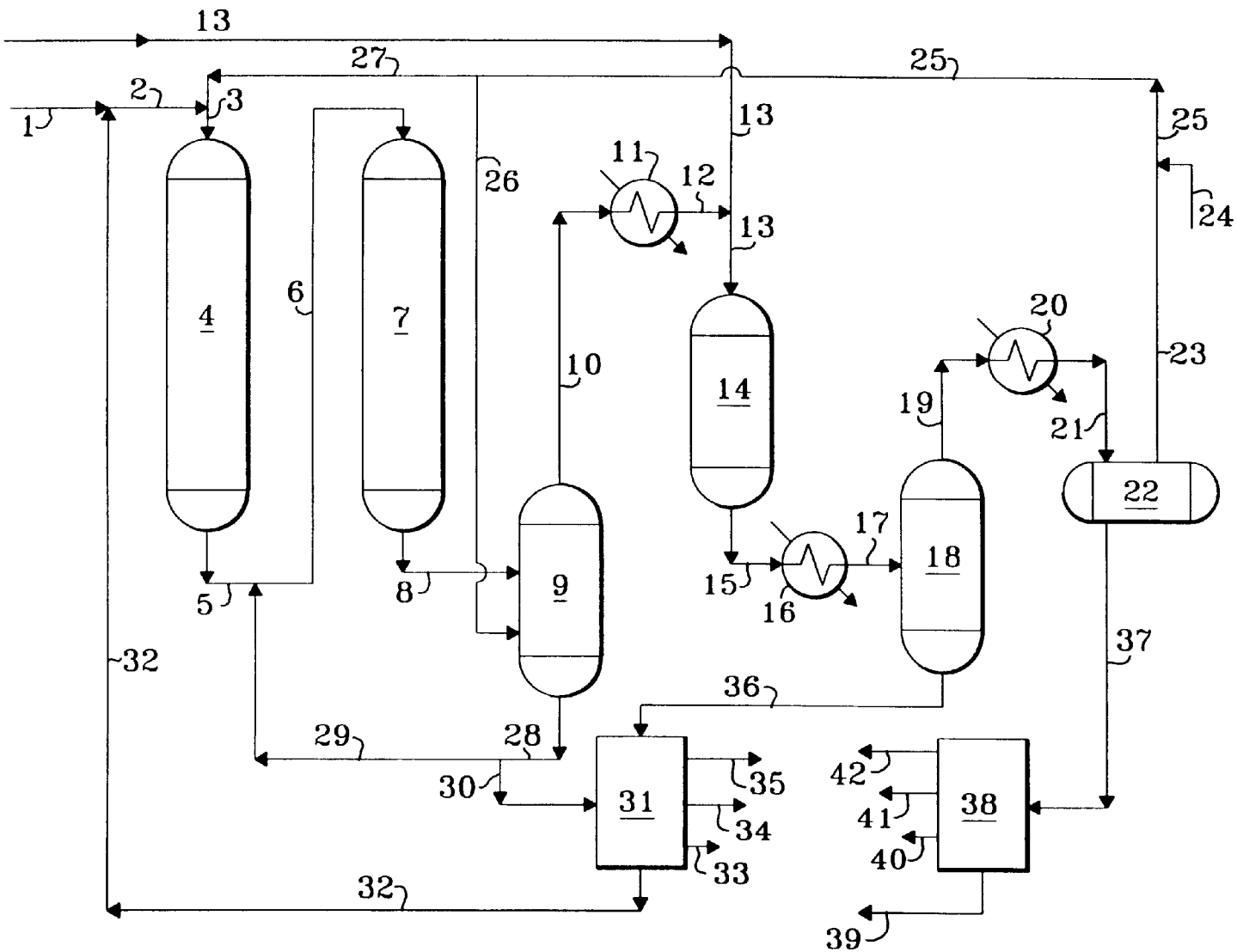
1
2
3
4
5
6
7
8
9
10
11
12
13
14
15
16
17
18
19
20
21
22
23
24
25
26
27
28
29
30
31
32
33
34
35
36
37
38
39
40
41
42

DUAL RECYCLE HYDROCRACKING PROCESS

BACKGROUND OF THE INVENTION

The field of art to which this invention pertains is the hydrocracking of a hydrocarbonaceous feedstock. Petroleum refiners often produce desirable products such as turbine fuel, diesel fuel and other products known as middle distillates as well as lower boiling hydrocarbonaceous liquids such as naphtha and gasoline by hydrocracking a hydrocarbon feedstock derived from crude oil, for example. Feedstocks most often subjected to hydrocracking are gas oils and heavy gas oils recovered from crude oil by distillation. A typical atmospheric gas oil comprises a substantial portion of hydrocarbon components boiling above about 260° C. (500° F.), usually at least about 80 percent by weight boiling above 260° C. (500° F.). A typical vacuum gas oil normally has a boiling point range between about 315° C. (600° F.) and about 565° C. (1050° F.).

Hydrocracking is generally accomplished by contacting in a hydrocracking reaction vessel or zone the gas oil or other feedstock to be treated with a suitable hydrocracking catalyst under conditions of elevated temperature and pressure in the presence of hydrogen so as to yield a product containing a distribution of hydrocarbon products desired by the refiner. The operating conditions and the hydrocracking catalysts within a hydrocracking reactor influence the yield of the hydrocracked products.

Although a wide variety of process flow schemes, operating conditions and catalysts have been used in commercial activities, there is always a demand for new hydrocracking methods which provide lower costs, higher liquid product yields and better product quality.

INFORMATION DISCLOSURE

U.S. Pat. No. 5,720,872 (Gupta) discloses a process for hydroprocessing liquid feedstocks in two or more hydroprocessing stages, which are in separate reaction vessels and wherein each reaction stage contains a bed of hydroprocessing catalyst. The liquid product from the first reaction stage is sent to a low pressure stripping stage and stripped of hydrogen sulfide, ammonia and other dissolved gases. The stripped product stream is then sent to the next downstream reaction stage, the product from which is also stripped of dissolved gases and sent to the next downstream reaction stage until the last reaction stage, the liquid product of which is stripped of dissolved gases and collected or passed on for further processing. The flow of treat gas is in a direction opposite the direction in which the reaction stages are staged for the flow of liquid. Each stripping stage is a separate stage, but all stages are contained in the same stripper vessel.

U.S. Pat. No. 5,114,562 (Haun et al) discloses a process wherein a middle distillate petroleum stream is hydrotreated to produce a low sulfur and low aromatic product employing two reaction zones in series. The effluent of the first reaction zone is cooled and purged of hydrogen sulfide by stripping and then reheated by indirect heat exchange. The second reaction zone employs a sulfur-sensitive noble metal hydrogenation catalyst. Operating pressure and space velocity increase, and operating temperature decreases from the first to the second reaction zones. The '562 patent teaches that the hydroprocessing reactions of the hydrodenitrification and hydrodesulfurization will occur with very limited hydrocracking of the feedstock. Also, it is totally undesired to perform any significant cracking within the second reaction zone.

U.S. Pat. No. 3,540,999 (Jacobs) discloses a process for converting heavier hydrocarbonaceous material into jet fuel kerosene and gasoline fractions. The simultaneous production of both jet fuel and gasoline fractions, in maximum quantities, is afforded through the utilization of a modified "series-flow" system. A two-stage process in which the jet fuel kerosene fraction is produced in the first stage with the gasoline fraction being produced in the second stage.

BRIEF SUMMARY OF THE INVENTION

The present invention is a catalytic hydrocracking process, which provides high liquid yields of low sulfur gasoline and ultra low sulfur diesel while simultaneously processing two feedstocks. One preferred feedstock boils in the temperature range of diesel and the second preferred feedstock boils in the temperature range above that of diesel. The process of the present invention is particularly useful in a revamp of an existing maximum naphtha hydrocracker in order to maximize or increase throughput while co-producing ultra low sulfur diesel from two feedstocks.

In accordance with one embodiment, the present invention relates to a hydrocracking process for maximum production of ultra low sulfur diesel which process comprises: (a) contacting a first hydrocarbonaceous feedstock and hydrogen with a hydrotreating catalyst in a first hydrotreating reaction zone at reaction conditions including a temperature from about 204° to 482° C. (400° to 900° F.) and a pressure from about 3.6 to 17.3 MPa (500 to 2500 psig) and recovering a hydrotreating reaction zone effluent therefrom; (b) passing at least a portion of the first hydrotreating reaction zone effluent and a hereinafter described liquid hydrocarbonaceous recycle stream to a hydrocracking reaction zone containing hydrocracking catalyst and operated at reaction zone conditions including a temperature from about 204° to 482° C. (400° to 900° F.) and a pressure from about 3.6 to 17.3 MPa (500 to 2500 psig) and recovering a hydrocracking reaction zone effluent therefrom; (c) introducing the hydrocracking reaction zone effluent into a high pressure stripper to produce a hydrocarbonaceous vapor stream comprising hydrogen, hydrogen sulfide and hydrocarbons boiling in the diesel range, and a liquid hydrocarbonaceous stream comprising hydrocarbons boiling at and above the diesel range and saturated with hydrogen; (d) recycling at least a portion of the liquid hydrocarbonaceous stream produced in step (c) to the hydrocracking zone in step (b) as at least a portion of the liquid hydrocarbonaceous recycle stream; (e) fractionating in a fractionation zone at least a portion of the liquid hydrocarbonaceous stream produced in step (c) to produce a first stream of ultra low sulfur diesel and a stream comprising hydrocarbons boiling at a temperature above the diesel range; (f) recycling at least a portion of the stream comprising hydrocarbons boiling at a temperature above the diesel range produced in step (e) to the first hydrotreating reaction zone in step (a); (g) contacting the hydrocarbonaceous vapor stream from step (c) and a second hydrocarbonaceous feedstock comprising diesel boiling range hydrocarbons with a hydrotreating catalyst in a second hydrotreating reaction zone; and (h) fractionating at least a portion of the effluent from the second hydrotreating reaction zone to produce a second stream of ultra low sulfur diesel.

Other embodiments of the present invention encompass further details such as types and descriptions of feedstocks, hydrotreating catalysts and preferred operating conditions including temperatures and pressures, all of which are hereinafter disclosed in the following discussion of each of these facets of the invention.

BRIEF DESCRIPTION OF THE DRAWING

The drawing is a simplified process flow diagram of a preferred embodiment of the present invention. The drawing is intended to be schematically illustrative of the present invention and not be a limitation thereof.

DETAILED DESCRIPTION OF THE INVENTION

It has been discovered that higher throughputs and higher liquid yields of ultra low sulfur diesel can be achieved in the above-described hydrocracking process.

The process of the present invention is particularly useful for hydrocracking a hydrocarbonaceous oil containing hydrocarbons and/or other organic materials to produce a product containing hydrocarbons and/or other organic materials of lower average boiling point and lower average molecular weight. The hydrocarbonaceous feedstocks that may be subjected to hydrocracking by the method of the invention include all mineral oils and synthetic oils (e.g., shale oil, tar sand products, etc.) and fractions thereof. Illustrative hydrocarbonaceous feedstocks include those containing components boiling above 260° C. (500° F.), such as atmospheric gas oils, vacuum gas oils, deasphalted, vacuum, and atmospheric residua, hydrotreated or mildly hydrocracked residual oils, coker distillates, straight run distillates, solvent-deasphalted oils, pyrolysis-derived oils, high boiling synthetic oils, cycle oils and cat cracker distillates. A preferred hydrocracking feedstock is a gas oil or other hydrocarbon fraction having at least 50% by weight, and most usually at least 75% by weight, of its components boiling at temperatures above the end point of the desired product. One of the most preferred gas oil feedstocks will contain hydrocarbon components which boil above 260° C. (500° F.), with best results being achieved with feeds containing at least 25 percent by volume of the components boiling between 315° C. (600° F.) and 538° C. (1000° F.). A preferred heavy feedstock boils in the range from about 93 to about 565° C. (200–1050° F.).

A co-feed is preferably petroleum distillates boiling in the range from about 204° C. to about 427° C. (400° to 800° F.). The present invention is particularly suited for the production of ultra low sulfur diesel.

The first selected feedstock is first introduced into a hydrotreating reaction zone together with a first liquid recycle stream and hydrogen at hydrotreating reaction conditions. Preferred hydrotreating reaction conditions include a temperature from about 204° C. (400° F.) to about 482° C. (900° F.), a pressure from about 3.6 MPa (500 psig) about 17.3 MPa (2500 psig), a liquid hourly space velocity of the fresh hydrocarbonaceous feedstock from about 0.1 $hr^{-1}$ to about 10 $hr^{-1}$ with a hydrotreating catalyst or a combination of hydrotreating catalysts.

The term "hydrotreating" as used herein refers to processes wherein a hydrogen-containing treat gas is used in the presence of suitable catalysts which are primarily active for the removal of heteroatoms, such as sulfur and nitrogen and for hydrogenation of aromatics. Suitable hydrotreating catalysts for use in the present invention are any known conventional hydrotreating catalysts and include those which are comprised of at least one Group VIII metal, preferably iron, cobalt and nickel, more preferably cobalt and/or nickel and at least one Group VI metal, preferably molybdenum and tungsten, on a high surface area support material, preferably alumina. Other suitable hydrotreating catalysts include zeolitic catalysts, as well as noble metal catalysts where the noble metal is selected from palladium and platinum. It is within the scope of the present invention that more than one type of hydrotreating catalyst be used in the same reaction vessel. The Group VIII metal is typically present in an amount ranging from about 2 to about 20 weight percent, preferably from about 4 to about 12 weight percent. The Group VI metal will typically be present in an amount ranging from about 1 to about 25 weight percent, preferably from about 2 to about 25 weight percent. Typical hydrotreating temperatures range from about 204° C. (400° F.) to about 482° C. (900° F.) with pressures from about 3.6 MPa (500 psig) to about 17.3 MPa (2500 psig), preferably from about 3.6 MPa (500 psig) to about 13.9 MPa (2000 psig).

The resulting effluent from the first hydrotreating reaction zone and a second liquid hydrocarbonaceous recycle stream saturated with hydrogen is then introduced into a hydrocracking zone. The hydrocracking zone may contain one or more beds of the same or different catalyst. In one embodiment, when the preferred products are middle distillates, the preferred hydrocracking catalysts utilize amorphous bases or low-level zeolite bases combined with one or more Group VIII or Group VIB metal hydrogenating components. In another embodiment, when the preferred products are in the gasoline boiling range, the hydrocracking zone contains a catalyst which comprises, in general, any crystalline zeolite cracking base upon which is deposited a minor proportion of a Group VIII metal hydrogenating component. Additional hydrogenating components may be selected from Group VIB for incorporation with the zeolite base. The zeolite cracking bases are sometimes referred to in the art as molecular sieves and are usually composed of silica, alumina and one or more exchangeable cations such as sodium, magnesium, calcium, rare earth metals, etc. They are further characterized by crystal pores of relatively uniform diameter between about 4 and 14 Angstroms ($10^{-10}$ meters). It is preferred to employ zeolites having a relatively high silica/alumina mole ratio between about 3 and 12. Suitable zeolites found in nature include, for example, mordenite, stilbite, heulandite, ferrierite, dachiardite, chabazite, erionite and faujasite. Suitable synthetic zeolites include, for example, the B, X, Y and L crystal types, e.g., synthetic faujasite and mordenite. The preferred zeolites are those having crystal pore diameters between about 8–12 Angstroms ($10^{-10}$ meters), wherein the silica/alumina mole ratio is about 4 to 6. A prime example of a zeolite falling in the preferred group is synthetic Y molecular sieve.

The natural occurring zeolites are normally found in a sodium form, an alkaline earth metal form, or mixed forms. The synthetic zeolites are nearly always prepared first in the sodium form. In any case, for use as a cracking base it is preferred that most or all of the original zeolitic monovalent metals be ion-exchanged with a polyvalent metal and/or with an ammonium salt followed by heating to decompose the ammonium ions associated with the zeolite, leaving in their place hydrogen ions and/or exchange sites which have actually been decationized by further removal of water. Hydrogen or "decationized" Y zeolites of this nature are more particularly described in U.S. Pat. No. 3,130,006.

Mixed polyvalent metal-hydrogen zeolites may be prepared by ion exchanging first with an ammonium salt, then partially back exchanging with a polyvalent metal salt and then calcining. In some cases, as in the case of synthetic mordenite, the hydrogen forms can be prepared by direct acid treatment of the alkali metal zeolites. The preferred cracking bases are those which are at least about 10 percent, and preferably at least 20 percent, metal-cation-deficient, based on the initial ion-exchange capacity. A specifically desirable and stable class of zeolites are those wherein at least about 20 percent of the ion exchange capacity is satisfied by hydrogen ions.

The active metals employed in the preferred hydrocracking catalysts of the present invention as hydrogenation components are those of Group VIII, i.e., iron, cobalt, nickel, ruthenium, rhodium, palladium, osmium, iridium and platinum. In addition to these metals, other promoters may also be employed in conjunction therewith, including the metals of Group VIB, e.g., molybdenum and tungsten. The amount of hydrogenating metal in the catalyst can vary within wide ranges. Broadly speaking, any amount between about 0.05 percent and 30 percent by weight may be used. In the case of the noble metals, it is normally preferred to use about 0.05 to about 2 weight percent. The preferred method for incorporating the hydrogenating metal is to contact the zeolite base material with an aqueous solution of a suitable compound of the desired metal wherein the metal is present in a cationic form. Following addition of the selected hydrogenating metal or metals, the resulting catalyst powder is then filtered, dried, pelleted with added lubricants, binders or the like if desired, and calcined in air at temperatures of, e.g., 371°–648° C. (700°–1200° F.) in order to activate the catalyst and decompose ammonium ions. Alternatively, the zeolite component may first be pelleted, followed by the addition of the hydrogenating component and activation by calcining. The foregoing catalysts may be employed in undiluted form, or the powdered zeolite catalyst may be mixed and copelleted with other relatively less active catalysts, diluents or binders such as alumina, silica gel, silica-alumina cogels, activated clays and the like in proportions ranging between 5 and 90 weight percent. These diluents may be employed as such or they may contain a minor proportion of an added hydrogenating metal such as a Group VIB and/or Group VIII metal.

Additional metal promoted hydrocracking catalysts may also be utilized in the process of the present invention which comprises, for example, aluminophosphate molecular sieves, crystalline chromosilicates and other crystalline silicates. Crystalline chromosilicates are more fully described in U.S. Pat. No. 4,363,718 (Klotz).

The hydrocracking of the hydrocarbonaceous feedstock in contact with a hydrocracking catalyst is conducted in the presence of hydrogen and preferably at hydrocracking reactor conditions which include a temperature from about 232° C. (450° F.) to about 468° C. (875° F.), a pressure from about 3.6 MPa (500 psig) to about 20.8 MPa (3000 psig), a liquid hourly space velocity (LHSV) from about 0.1 to about 30 $hr^{-1}$, and a hydrogen circulation rate from about 337 normal $m^3/m^3$ (2000 standard cubic feet per barrel) to about 4200 normal $m^3/m^3$ (25,000 standard cubic feet per barrel). In accordance with the present invention, the term "substantial conversion to lower boiling products" is meant to connote the conversion of at least 5 volume percent of the fresh feedstock. In a preferred embodiment, the per pass conversion in the hydrocracking zone is in the range from about 15% to about 45%. More preferably the per pass conversion is in the range from about 20% to about 40%.

The resulting effluent from the hydrocracking reaction zone is transferred into a hot, high pressure stripping zone maintained at essentially the same pressure as the hydrocracking zone, and contacted and countercurrently stripped with a hot hydrogen-rich gaseous stream to produce a first gaseous hydrocarbonaceous stream containing a majority of hydrocarbonaceous compounds boiling at a temperature less than about 343° C. (650° F.), hydrogen sulfide and ammonia, and a first liquid hydrocarbonaceous stream containing a majority of hydrocarbonaceous compounds boiling at a temperature greater than about 343° C. (650° F.). The stripping zone is preferably maintained at a temperature in the range from about 149° C. (300° F.) to about 468° C. (875° F.) and a pressure from about 3.6 to 17.3 MPa (500 to 2500 psig). It is preferred that any cooling of the hydrocracking zone effluent prior to stripping is less than about 100° C. (180° F.). By maintaining the pressure of the stripping zone at essentially the same pressure as the hydrocracking zone, it is meant that any difference in pressure is due to the pressure drop required to flow the effluent stream from the hydrocracking zone to the stripping zone. It is preferred that the pressure drop is less than about 1.1 MPa (150 psig ). The hot hydrogen-rich gaseous stream is preferably supplied to the stripping zone in an amount from about 85 $nm^3/m^3$ (500 SCFB) to about 2530 $nm^3/m^3$ (15,000 SCFB) of the hydrocarbonaceous feedstock.

At least a portion of the first liquid hydrocarbonaceous stream containing a majority of hydrocarbonaceous compounds boiling at a temperature greater than about 343° C. (650° F.) recovered from the stripping zone is introduced into the hydrocracking reaction zone along with the effluent from the first hydrotreating reaction zone. The resulting first gaseous hydrocarbonaceous stream containing a majority of hydrocarbonaceous compounds boiling at a temperature less than about 343° C. (650° F.), hydrogen, hydrogen sulfide and ammonia from the stripping zone and a second hydrocarbonaceous feedstock containing diesel boiling range hydrocarbons is introduced into a second hydrotreating reaction zone at hydrotreating reaction conditions. Preferred hydrotreating reaction conditions include a temperature from about 204° C. (400° F.) to about 482° C. (900° F.) and a pressure from about 3.6 MPa (500 psig) to about 17.3 MPa (2500 psig) with a hydrotreating catalyst or a combination of hydrotreating catalysts.

The effluent from the second hydrotreating reaction zone is preferably cooled to a temperature in the range from about 175° C. (350° F.) to about 370° C. (700° F.) and at least partially condensed to produce a second liquid hydrocarbonaceous stream which is introduced into a first fractionation zone and a gaseous hydrocarbonaceous stream containing diesel boiling range hydrocarbons, hydrogen and hydrogen sulfide which is preferably cooled to a temperature in the range from about 4.4° C. (40° F.) to about 60° C. (140° F.) and at least partially condensed to produce a third liquid hydrocarbonaceous stream which is recovered and fractionated in a second fractionation zone to produce ultra low sulfur diesel, and a hydrogen-rich gaseous stream containing hydrogen sulfide. Ultra low sulfur diesel contains preferably less than 100, more preferably less than 50 and even more preferably less than 10 wppm sulfur. The hydrogen-rich gaseous stream is preferably bifurcated to provide at least a portion of the added hydrogen introduced into the first hydrotreating reaction zone as hereinabove described and at least a portion of the hydrogen-rich gaseous stream introduced into the high pressure stripping zone. Fresh makeup hydrogen may be introduced into the process at any suitable and convenient location. Before the recovered hydrogen-rich gaseous stream containing hydrogen sulfide is utilized, it is preferred that at least a significant portion, at least about 90 weight percent, for example, of the hydrogen sulfide is removed and recovered by means of known, conventional methods. In a preferred embodiment, after the hydrogen sulfide removal, the hydrogen-rich gaseous stream contains less than about 50 volume ppm hydrogen sulfide. A heavy hydrocarbonaceous stream containing hydrocarbons boiling in the range of the first hydrocarbonaceous feedstock is removed from the first fractionation zone and introduced into the first hydrotreating zone together with the first hydrocarbonaceous feedstock.

DETAILED DESCRIPTION OF THE DRAWING

In the drawing, the process of the present invention is illustrated by means of a simplified schematic flow diagram in which such details as pumps, instrumentation, heat-exchange and heat-recovery circuits, compressors and similar hardware have been deleted as being non-essential to an understanding of the techniques involved. The use of such miscellaneous equipment is well within the purview of one skilled in the art.

With reference now to the drawing, a feed stream comprising atmospheric gas oil and light cycle oil is introduced into the process via line 1 and admixed with a hereinafter-described recycle oil transported via line 32. The resulting admixture is carried via line 2 and is admixed with a hydrogen recycle gas which is transported via line 27. This resulting admixture is introduced via line 3 into hydrotreating reaction zone 4. A resulting effluent from hydrotreating reaction zone 4 is carried via line 5 and is admixed with a liquid hydrocarbonaceous stream saturated with hydrogen carried via line 29 and the resulting admixture is carried via line 6 and introduced into hydrocracking zone 7. A resulting effluent from hydrocracking zone 7 is carried via line 8 and introduced into high pressure stripping zone 9. A vaporous stream containing hydrocarbons and hydrogen passes upward in high pressure stripping zone 9 and is removed from high pressure stripping zone 9 via line 10, heat-exchanger 1, line 12 and line 13 and is introduced into hydrotreating reaction zone 14. A second hydrocarbonaceous feedstock containing light cycle oil and coker distillate is introduced into the process via line 13 and is introduced into hydrotreating reaction zone 14. A resulting effluent is removed from hydrotreating reaction zone 14 via line 15 and introduced into heat-exchanger 16. A resulting cooled effluent is removed from heat-exchanger 16, carried via line 17 and introduced into hot vapor-liquid separator 18. A liquid hydrocarbonaceous stream is removed from hot vapor-liquid separator 18 via line 36 and introduced into fractionation zone 31. A portion of the liquid hydrocarbonaceous stream removed from high pressure stripping zone 9 is carried via lines 28 and 30 and introduced into fractionation zone 31. A normally gaseous hydrocarbon stream is removed from fractionation zone 31 via line 35 and recovered. A naphtha boiling range stream is removed from fractionation zone 31 via line 34 and recovered. A hydrocarbonaceous stream boiling in the diesel range and having a low sulfur concentration is removed from fractionation zone 31 via line 33 and recovered. A liquid hydrocarbonaceous stream boiling above the diesel boiling range is removed from fractionation zone 31 via line 32 and recycled to the first fresh feedstock as hereinabove described. A vaporous stream is removed from hot vapor-liquid separator 18 via line 19 and introduced into heat-exchanger 20. A resulting cooled effluent is removed from heat-exchanger 20 via line 21 and introduced into cold vapor-liquid separator 22. A hydrogen-rich gaseous stream is removed from cold vapor-liquid separator 22 via line 23 and admixed with makeup hydrogen which is introduced via line 24 and the resulting admixture is carried via line 25. A portion of the hydrogen-rich gaseous stream is carried via line 26 and is introduced into high pressure stripping zone 9 as a stripping gas. Another portion of the hydrogen-rich gaseous stream is carried via line 27 and line 3 and introduced into hydrotreating reaction zone 4 as hereinabove described. A liquid hydrocarbonaceous stream is removed from cold vapor-liquid separator 22 via line 37 and introduced into fractionation zone 38. A stream containing normally gaseous hydrocarbons is removed from fractionation zone 38 via line 42 and recovered. A hydrocarbon stream containing naphtha boiling range hydrocarbons is removed from fractionation zone 38 via line 41 and recovered. A kerosene boiling range hydrocarbon fraction is removed from fractionation zone 38 via line 40 and recovered. A stream containing diesel boiling range hydrocarbons and having a low concentration of sulfur is removed from fractionation zone 38 via line 39 and recovered.

The process of the present invention is further demonstrated by the following illustrative embodiment. This illustrative embodiment is, however, not presented to unduly limit the process of this invention, but to further illustrate the advantage of the hereinabove-described embodiment. The following data were not obtained by the actual performance of the present invention but are considered prospective and reasonably illustrative of the expected performance of the invention.

ILLUSTRATIVE EMBODIMENT

A first feedstock having the characteristics presented in Table 1 and in an amount of 5357 $m^3$/day (33,700 BPD) is passed through a first hydrotreating reaction zone and subsequently through a hydrocracking zone in accordance with the process of the present invention. A second feedstock having the characteristics presented in Table 2 and in an amount of 2925 $m^3$/day (18,400 BPD) is passed through the second hydrotreating reaction zone. Key operating conditions are presented in Table 3 and the product yields from the process of the present invention are presented in Table 4.

TABLE 1

First Feedstock Analysis
67/33 Blend Atmospheric Gas Oil-Light Cycle Oil

| | |
|---|---|
| Specific Gravity | 0.907 |
| Distillation, Volume Percent | |
| IBP, ° C. (° F.) | 103 (218) |
| 10 | 248 (479) |
| 30 | 305 (581) |
| 50 | 365 (689) |
| 70 | 390 (736) |
| 90 | 441 (825) |
| FBP | 546 (1014) |
| Sulfur, weight percent | 1.11 |
| Nitrogen, WPPM | 527 |

TABLE 2

Second Feedstock Analysis
50/50 Blend Light Cycle Oil and Coker Distillate

| | |
|---|---|
| Specific Gravity | 0.869 |
| Distillation, Volume Percent | |
| IBP, ° C. (° F.) | 113 (236) |
| 10 | 223 (434) |
| 30 | 257 (495) |
| 50 | 282 (545) |
| 70 | 314 (598) |
| 90 | 354 (670) |
| FBP | 412 (774) |
| Sulfur, weight percent | 0.83 |
| Nitrogen, WPPM | 600 |

TABLE 3

| Summary of Operating Conditions | | | | |
|---|---|---|---|---|
| Operating Conditions | HDT Reactor | HC Reactor | Diesel HDT Reactor | High Pressure Stripper |
| Pressure, MPa (PSIG) | 12 (1750) | 11.8 (1700) | 11.3 (1625) | 11.4 (1650) |
| Temperature, ° C. (° F.) | 371 (700) | 379 (715) | 365 (690) | 397 (715) |
| Stripping Gas, $nm^3/m^3$ | | | | 250 |

TABLE 4

| Product Yields | |
|---|---|
| Products, $m^3$/day (BPD) | |
| Propane | 133 (839) |
| Butane | 371 (2334) |
| Pentane | 309 (1943) |
| Naphtha | 3172 (19955) |
| Diesel (<10 ppmS) | 4942 (31088) |
| Unconverted Oil | 468 (2944) |

The foregoing description, drawing and illustrative embodiment clearly illustrate the advantages encompassed by the process of the present invention and the benefits to be afforded with the use thereof.

What is claimed is:

1. A hydrocracking process for maximum production of ultra low sulfur diesel which process comprises:

a) contacting a first hydrocarbonaceous feedstock and hydrogen with a hydrotreating catalyst in a first hydrotreating reaction zone at reaction conditions including a temperature from about 204° to 482° C. (400° to 900° F.) and a pressure from about 3.6 to 17.3 MPa (500 to 2500 psig) and recovering a hydrotreating reaction zone effluent therefrom;

b) passing at least a portion of the first hydrotreating reaction zone effluent and a hereinafter described liquid hydrocarbonaceous recycle stream to a hydrocracking reaction zone containing hydrocracking catalyst and operated at reaction zone conditions including a temperature from about 204° to 482° C. (400° to 900° F.) and a pressure from about 3.6 to 17.3 MPa (500 to 2500 psig) and recovering a hydrocracking reaction zone effluent therefrom;

c) introducing the hydrocracking reaction zone effluent into a high pressure stripper to produce a hydrocarbonaceous vapor stream comprising hydrogen, hydrogen sulfide and hydrocarbons boiling in the diesel range, and a liquid hydrocarbonaceous stream comprising hydrocarbons boiling at and above the diesel range and saturated with hydrogen;

d) recycling at least a portion of the liquid hydrocarbonaceous stream produced in step (c) to the hydrocracking zone in step (b) as at least a portion of the liquid hydrocarbonaceous recycle stream;

e) fractionating in a fractionation zone at least a portion of the liquid hydrocarbonaceous stream produced in step (c) to produce a first stream of ultra low sulfur diesel and a stream comprising hydrocarbons boiling at a temperature above the diesel range;

f) recycling at least a portion of the stream comprising hydrocarbons boiling at a temperature above the diesel range produced in step (e) to the first hydrotreating reaction zone in step (a);

g) contacting the hydrocarbonaceous vapor stream from step (c) and a second hydrocarbonaceous feedstock comprising diesel boiling range hydrocarbons with a hydrotreating catalyst in a second hydrotreating reaction zone; and h) fractionating at least a portion of the effluent from the second hydrotreating reaction zone to produce a second stream of ultra low sulfur diesel.

2. The process of claim 1 wherein at least a portion of the effluent from the second hydrotreating reaction zone is introduced into the fractionation zone of step (e).

3. The process of claim 1 wherein at least a portion of the effluent from the second hydrotreating reaction zone is recovered as a hydrogen-rich gaseous stream.

4. The process of claim 3 wherein at least a portion of the hydrogen-rich gaseous stream is introduced into the first hydrotreating reaction zone in step (a).

5. The process of claim 1 wherein at least a portion of the hydrogen-rich gaseous stream is introduced into the high-pressure stripper as stripping gas.

6. The process of claim 1 wherein the first hydrocarbonaceous feedstock boils in the range from about 93 to about 565° C. (200–1050° F.).

7. The process of claim 1 wherein the second hydrocarbonaceous feedstock boils in the range from about 204° C. to about 427° C. (400°–800° F.).

8. The process of claim 1 wherein the ultra low sulfur diesel comprises less than about 100 wppm sulfur.

9. The process of claim 1 wherein the ultra low sulfur diesel comprises less than about 50 wppm sulfur.

10. The process of claim 1 wherein the high pressure stripper is operated at a temperature from about 149° C. (300° F.) to about 468° C. (875° F.) and a pressure from about 3.6 to 17.3 MPa (500 to 2500 psig).

* * * * *